US012672706B2

(12) United States Patent
Kane

(10) Patent No.: US 12,672,706 B2
(45) **Date of Patent: *Jul. 7, 2026**

(54) KEYCASE

(71) Applicant: The Ridge Wallet LLC, Santa Monica, CA (US)

(72) Inventor: Daniel Kane, Agoura Hills, CA (US)

(73) Assignee: The Ridge Wallet LLC

( * ) Notice: Subject to any disclaimer, the term of this patent is extended or adjusted under 35 U.S.C. 154(b) by 0 days.

This patent is subject to a terminal disclaimer.

(21) Appl. No.: 18/739,241

(22) Filed: Jun. 10, 2024

(65) Prior Publication Data

US 2025/0176689 A1 Jun. 5, 2025

Related U.S. Application Data

(63) Continuation of application No. 17/677,876, filed on Feb. 22, 2022, now Pat. No. 12,004,616.

(51) Int. Cl.
*A45C 11/32* (2006.01)

(52) U.S. Cl.
CPC ..... *A45C 11/32* (2013.01)

(58) Field of Classification Search
CPC ..... A45C 11/32
USPC ..... 206/37.8
See application file for complete search history.

(56) References Cited

U.S. PATENT DOCUMENTS

| | | | | |
|---|---|---|---|---|
| 2,687,756 | A * | 8/1954 | Felt | A45C 11/324 206/37.8 |
| 3,053,072 | A * | 9/1962 | Morris | A45C 11/324 70/456 R |
| 3,832,874 | A * | 9/1974 | Willis | A45C 11/324 70/456 R |
| 6,672,118 | B1 * | 1/2004 | Wright | A45C 11/32 70/459 |
| 8,915,356 | B1 * | 12/2014 | Cha | A45C 13/1069 206/37.8 |
| 12,004,616 | B2 * | 6/2024 | Kane | A45C 11/32 |

* cited by examiner

*Primary Examiner* — Anthony D Stashick
*Assistant Examiner* — Marcos Javier Rodriguez Molina
(74) *Attorney, Agent, or Firm* — K&L Gates LLP; Brian J. Novak; Giorgios N. Kefallinos

(57) ABSTRACT

A keycase includes a longitudinal top plate, a longitudinal bottom plate, a flexible connector connecting the longitudinal top plate and the longitudinal bottom plate, a key post coupled to the longitudinal bottom plate and extending from the longitudinal bottom plate toward the longitudinal top plate. The key post is configured to hold one or more keys. The key case further includes a fastener configured to detachably connect the key post and the longitudinal top plate and secure the key post with the longitudinal top plate, and a key pushing liner coupled to the longitudinal bottom plate and configured to push the one or more keys toward the longitudinal top plate.

20 Claims, 6 Drawing Sheets

KEYCASE

BACKGROUND

The present disclosure generally relates to a keycase for stacking one or more keys. More particularly, the present disclosure is directed to a keycase for holding one or more keys neatly. Conventional key holders may have a ring shape, into which keys are inserted. However, normally, the keys in such ring-shape key holders move freely within the ring and make noisy jangling sounds.

SUMMARY

The present disclosure provides a new and innovative keycase. In an embodiment, a keycase may include a longitudinal top plate, a longitudinal bottom plate, a flexible connector connecting the longitudinal top plate and the longitudinal bottom plate, and a key post coupled to the longitudinal bottom plate and extending from the longitudinal bottom plate toward the longitudinal top plate. The key post may be configured to hold one or more keys. The key case may further include a fastener configured to detachably connect the key post and the longitudinal top plate and secure the key post with the longitudinal top plate, and a key pushing liner coupled to the longitudinal bottom plate and configured to push the one or more keys toward the longitudinal top plate.

In some examples, the flexible connector may be made of a silicon material.

In some examples, the keycase may further include a pocket clip coupled to an outer surface of the longitudinal bottom plate.

In some examples, the keycase may further include a spacer coupled between an end portion of the pocket clip and the outer surface of the longitudinal bottom plate.

In some examples, the key pushing liner may include a fixed portion and a floating portion, where the fixed portion is coupled to an inner surface of the longitudinal bottom plate.

In some examples, the floating portion of the key pushing liner may include a first end and a second end opposite the first end, where the second end is connected to the fixed portion of the key pushing liner. The floating portion may extend from the second end towards the key post so that the first end of the floating portion is located closer to the key post than the second end of the floating portion. The first end of the floating portion may be spaced apart from the longitudinal bottom plate when no pressure is applied to the floating portion of the key pushing liner.

In some examples, the first end of the floating portion may be spaced apart from the key post when no pressure is applied to the floating portion of the key pushing liner.

In some examples, a distance between the first end of the floating portion and the key post may be in a range of 0.5 mm to 3 mm.

In some examples, the first end of the floating portion may include a notch.

In some examples, the first end of the floating portion may include a bent portion.

In some examples, the floating portion may include an internal recess.

In some examples, the key pushing liner may be made from a single metal piece.

In some examples, the longitudinal top plate may include a concave portion in a side portion of the longitudinal top plate. The concave portion may be configured to assist in pushing the one or more keys out.

In some examples, the fastener may include a screw.

In other examples, a keycase may include a longitudinal top plate having a first end portion and a second end portion opposite the first end portion, a longitudinal bottom plate having a first end portion and a second end portion opposite the first end portion, and a connector connecting the longitudinal top plate and the longitudinal bottom plate. The connector may include a first end portion and a second end portion opposite the first end portion. The first end portion of the connector may be connected to the second end portion of the longitudinal top plate and the second end portion of the connector may be connected to the second end portion of the longitudinal bottom plate. The keycase may further include a key post coupled to the first end portion of the longitudinal bottom plate and extending from the first end portion of the longitudinal bottom plate toward the first end portion of the longitudinal top plate, where the key post is configured to hold one or more keys, a fastener configured to detachably connect the key post and the first end portion of the longitudinal top plate and secure the key post with the longitudinal top plate, and a key pushing liner coupled to the longitudinal bottom plate and configured to push the one or more keys toward the longitudinal top plate.

In other examples, a key pushing liner for a keycase may include a fixed portion configured to be fixed to a bottom plate of the keycase and a floating portion connected to the fixed portion. The floating portion may include a first end portion and a second end portion opposite the first end portion. The second end portion of the floating portion may be connected to the fixed portion. The floating portion may be bent from the fixed portion and the first end portion of the floating portion may be floating.

Aspects of the present disclosure may provide a keycase that is capable of holding various types of and amounts of keys in a slim vertical fashion.

Additional features and advantages of the disclosed keycase are described in, and will be apparent from, the following Detailed Description and the Figures.

Figure 1:
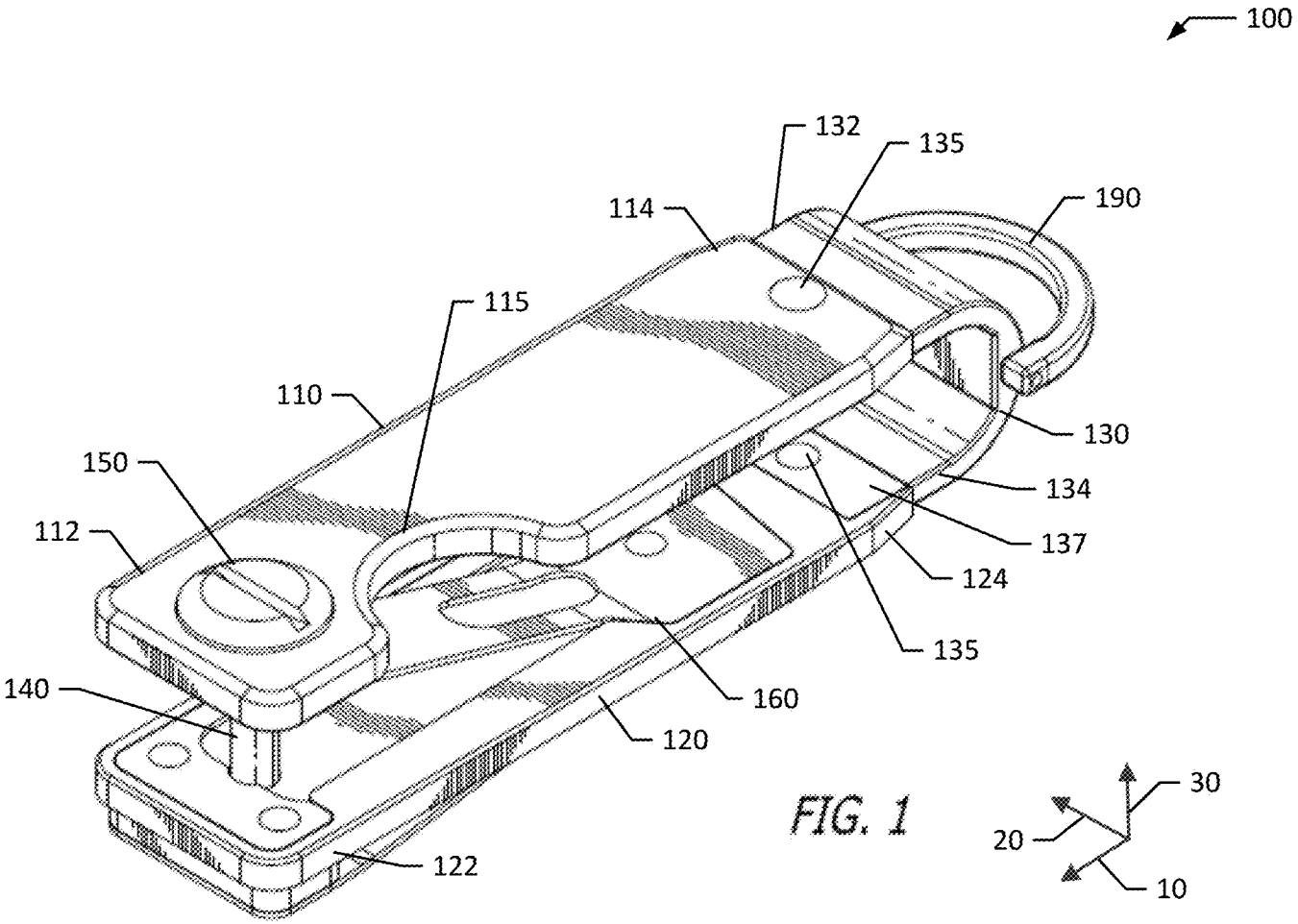
FIG. 1 is a perspective view of a keycase according to a non-limiting embodiment of the present disclosure.

The reader will appreciate the foregoing details, as well as others, upon considering the following detailed description of certain non-limiting embodiments of devices according to the present disclosure. The reader also may comprehend certain of such additional details upon using the devices described herein.

DETAILED DESCRIPTION

The following discussion is directed to various exemplary embodiments. However, one of ordinary skill in the art will understand that the examples disclosed herein have broad application, and that the discussion of any embodiment is meant only to be exemplary of that embodiment, and not intended to suggest that the scope of the disclosure, including the claims, is limited to that embodiment.

The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through a direct connection of the two devices, or through an indirect connection that is established via other devices, components, nodes, and connections. In addition, as used herein, the terms "axial" and "axially" generally mean along or parallel to a given axis (e.g., central axis of a body or a port), while the terms "radial" and "radially" generally mean perpendicular to the given axis. For instance, an axial distance refers to a distance measured along or parallel to the axis, and a radial distance means a distance measured perpendicular to the axis.

As used herein, "about," "approximately" and "substantially" are understood to refer to numbers in a range of numerals, for example the range of −10% to +10% of the referenced number, preferably −5% to +5% of the referenced number, more preferably-1% to +1% of the referenced number, most preferably −0.1% to +0.1% of the referenced number. Moreover, these numerical ranges should be construed as providing support for a claim directed to any number or subset of numbers in that range. For example, a disclosure of from 1 to 10 should be construed as supporting a range of from 1 to 8, from 3 to 7, from 1 to 9, from 3.6 to 4.6, from 3.5 to 9.9, and so forth.

Figure 2:
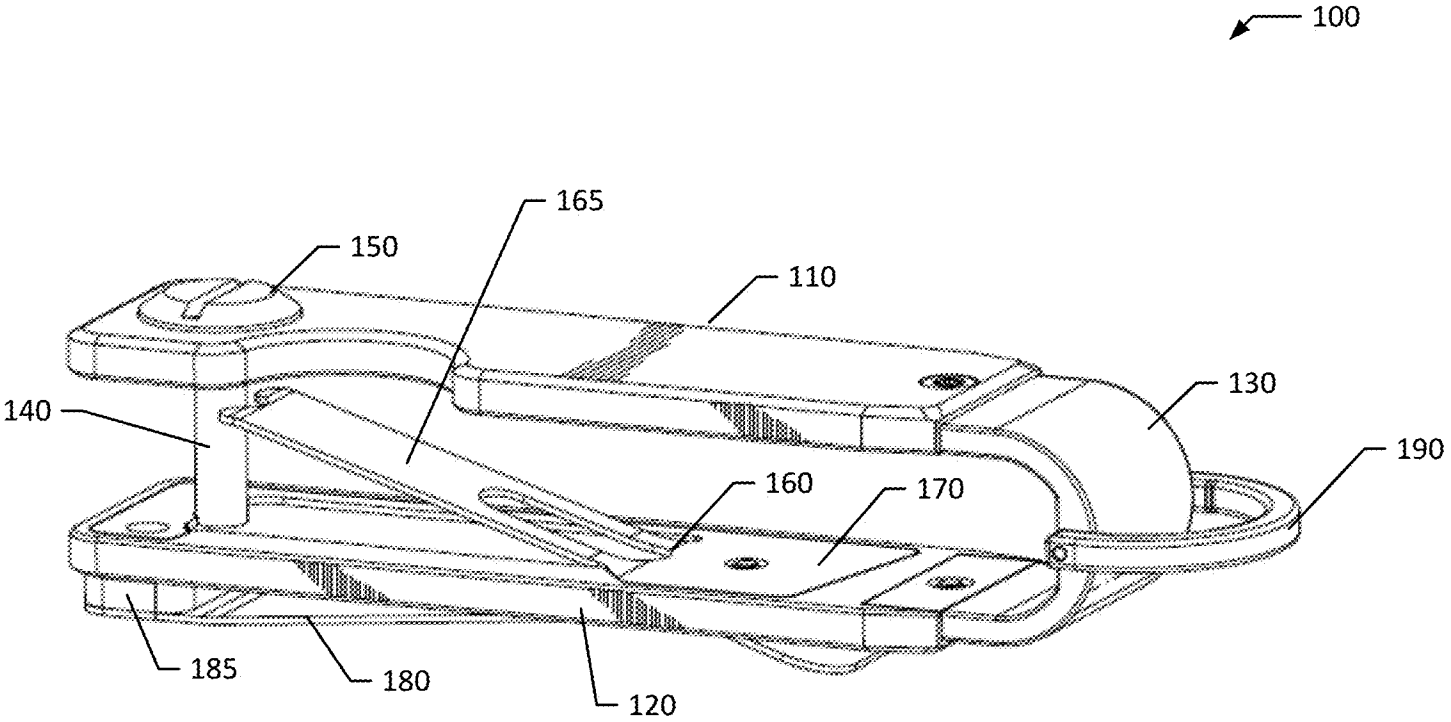
FIG. 2 is another perspective view of the keycase of FIG. 1.

Referring to FIGS. 1 to 2, an example keycase 100 according to the present disclosure is shown. In some examples, the keycase 100 may include a top plate 110, a bottom plate 120, and a connector 130. The keycase 100 may define a length direction 10, a width direction 20, and a height direction 30. The top plate 110 and the bottom plate 120 may extend longitudinally in the length direction 10. The top plate 110 may have a first end portion 112 and a second end portion 114 opposite the first end portion 112. The bottom plate 120 may have a first end portion 122 and a second end portion 124 opposite the first end portion 122. The connector 130 may connect the longitudinal top plate 110 with the longitudinal bottom plate 120. The connector 130 may include a first end portion 132 and a second end portion 134 opposite the first end portion 132. The first end portion 132 of the connector 130 may be connected to the second end portion 114 of the longitudinal top plate 110, and the second end portion 134 of the connector 130 may be connected to the second end portion 124 of the longitudinal bottom plate 120.

In some examples, the first and second end portions 132, 134 of the connector 130 may have a male protrusion. The second end portion 114 of the top plate 110 and the second end portion 124 of the bottom plate 120 may have a female groove configured to receive the corresponding male protrusion of the first and second end portions 132, 134 of the connector 130. In some examples, when the male protrusion of the first and second end portions 132, 134 of the connector 130 is inserted into the corresponding female groove of the second end portions 114, 124 of the top/bottom plate 110/120, one or more fasteners 135 (e.g., screw, bolt) may be used (e.g., pierced into, in the height direction 30, the portion where the protrusion is inserted into the groove) to fix the connection between the connector 130 and the top/bottom plates 110/120.

In some examples, the thickness of the protrusion of the first and second end portions 132, 134 of the connector 130 may be thinner than the thickness of other portions of the connector 130. In other example, the thickness of the protrusion of the first and second end portions 132, 134 of the connector 130 may be the same as the thickness of other portions of the connector 130.

In some examples, a reinforcing plate 137 may be attached to the inner surface of the second end portions 114, 124 of the top/bottom plate 110/120. The reinforcing plate 137 may extend longitudinally in the width direction 20. The reinforcing plate 137 may be provided to reinforce the strength of the portion where the connector 130 and the top/bottom plate 110/120 are connected to each other. In some examples, the reinforcing plate 137 may be made with a metal material. In other examples, the reinforcing plate 137 may be made with any other suitable material (e.g., plastic, wood) having sufficient strength. In other examples, the connector 130 and the top/bottom plates 110/120 can be connected to each other in any other suitable way.

In some examples, the top/bottom plate 110/120 may have a length in a range of about 45 mm to about 75 mm and a width in a range of about 15 mm to about 26 mm. In other examples, the top/bottom plate 110/120 may have any other suitable length and width. In some examples, the keycase 100 may have a height in a range of about 8 mm to about 25 mm. In other examples, the keycase 100 may have any other suitable height. In some examples, the top/bottom plate 110/120 may be made with a metal material (e.g., aluminum, titanium). In other examples, the top/bottom plate 110/120 may be made with any other suitable material (e.g., carbon fiber, thermoset polymer, polycarbonate, wood).

In some examples, the connector 130 may be made of a flexible material, such as a silicon material. In other examples, the connector 130 may be made of any other suitable material (e.g., flexible material or non-flexible material, such as metal, plastic, wood). The flexible connector 130 may be able to expand and contract based on how many keys are inserted into the key post 140. In some examples, the connector 130 may be curved. For example, the connector 130 may have a semi-circle shape. In other examples, the connector 130 may have any other suitable shape.

In some examples, the keycase 100 may further include a key post 140. The key post 140 may be coupled to the bottom plate 120. For example, the key post 140 may be coupled to the first end portion 122 of the longitudinal bottom plate 120 and extend from the first end portion 122 of the longitudinal bottom plate 120 toward the first end portion 112 of the longitudinal top plate 110. The key post may be configured to hold one or more keys. In some examples, the key post 140 may have a height T1 (e.g., in the height direction 30) in a range of about 6 mm to about 12 mm. In other examples, the key post 140 may have any other suitable height T1. In some examples, the key post 140 may be made with a metal material (e.g., aluminum, titanium, steel). In other examples, the key post 140 may be made with any other suitable material (e.g., plastic, wood).

Figure 4:
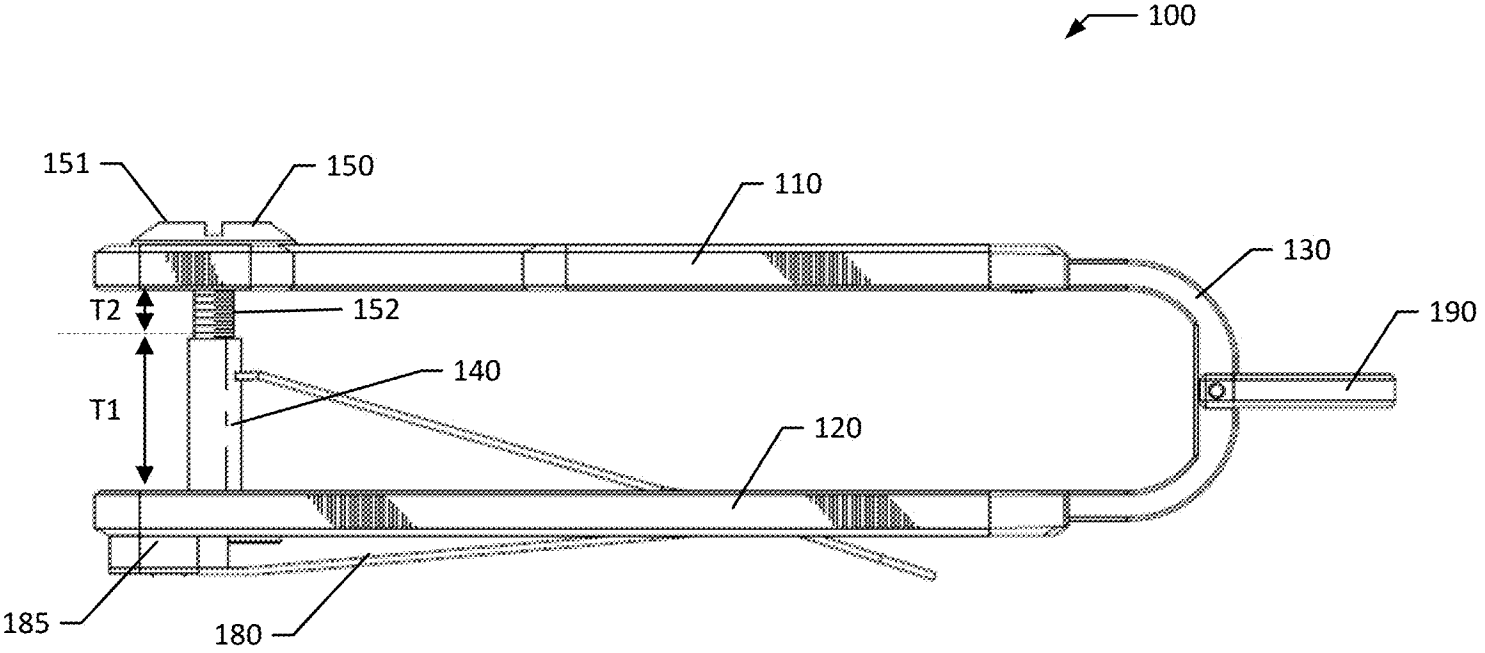
FIG. 4 is a side view of the keycase of FIG. 1 in an extended state.

In some examples, the keycase 100 may also include a fastener 150. The fastener 150 may be configured to detachably connect the key post 140 with the top plate 110 (e.g., the first end portion 112) and secure the key post 140 with the top plate 110. Examples of the fastener 150 may include a screw, a bolt, rivet, nail, or any other suitable component in a stick/post shape. When the bolt, rivet, and/or nail are used as the fastener, additional components (e.g., a nut) may be provided to removably fix the fastener 150 to the top plate 110. In some examples, the top plate 110 may include a hole (e.g., threaded hole) to receive the fastener 150. As shown in FIG. 4, in some examples, the fastener 150 may include a head portion 151 and/or a post portion 152. The post portion 152 of the fastener 150 may be configured to be connected to the key post 140. In some examples, the post portion 152 of the fastener may have a height in a range of about 10 mm to 16 mm. In other examples, the post portion 152 of the fastener may have any other suitable height.

A user of the keycase 100 may be able to insert one or more keys into the key post 140 when the fastener 150 is not engaged with the key post 140 (e.g., when the fastener 150 is removed and/or detached from the key post 140). At this time, a gap is formed between the key post 140 and the top plate 110. The user can insert a desired number of keys into the key post 140 through this gap. Once a desired number of keys are inserted into the key post 140, the user can lock the key post 140 by closing the gap using the fastener 150 (e.g., connecting the key post 140 with the top plate 110). In some examples, the key post 140 may have an internal hole (e.g., a threaded hole) configured to receive the fastener 150.

Figure 3:
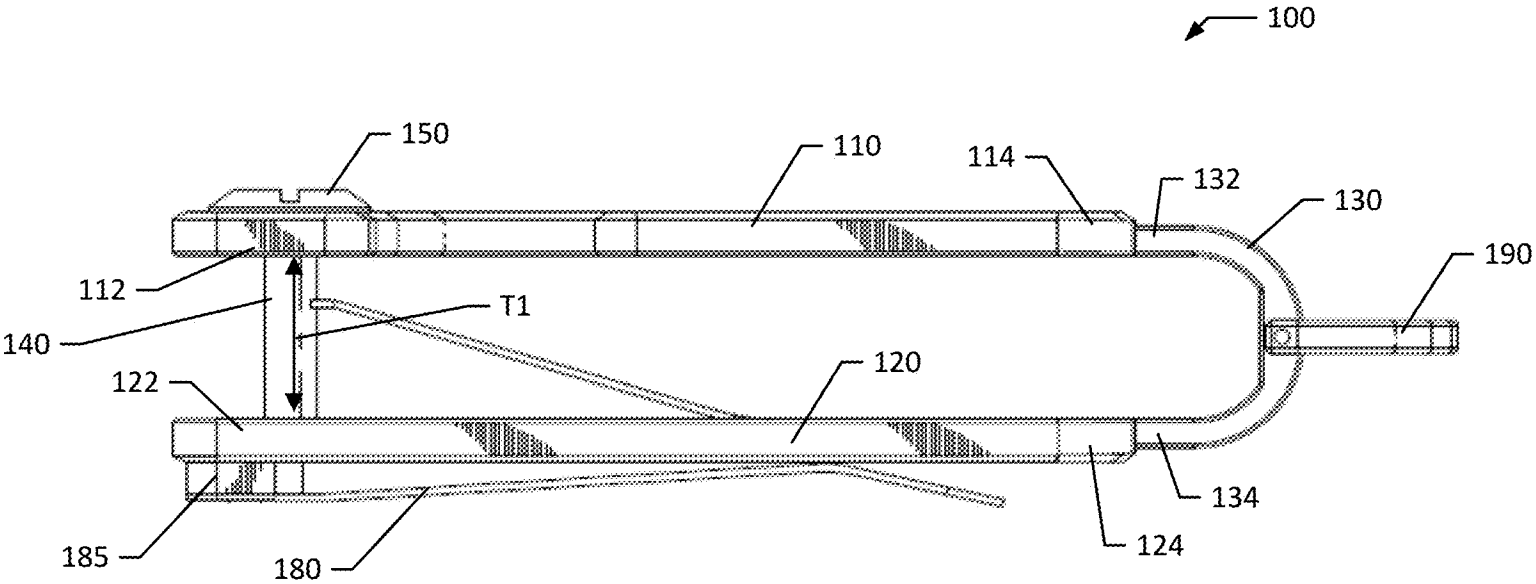
FIG. 3 is a side view of the keycase of FIG. 1 in a fully compressed state.

In some examples, the keycase 100 can be extended, for example, in the height direction 30, which may enable the keycase 100 to hold more keys. FIG. 3 shows the keycase 100 when the keycase 100 is in a fully compressed state (e.g., when the fastener 150 is fully engaged with the key post 140). In this case, the distance between the top plate 110 and the bottom plate 120 may be the same as or similar to the height of the key post 140, which is T1. In some examples, the keycase 100 may be able to hold up to three to five keys in the compressed state. In other examples, the keycase 100 may be able to hold any other number of keys in the compressed state.

FIG. 4 shows the keycase 100 in an extended state (e.g., when the fastener 150 is not fully engaged with the key post 140). In this state, the fastener 150 may be partially disengaged/released from the key post 140, but still firmly fixed to the key post 140, connecting the key post 140 with the top plate 110. For example, when the fastener 150 is a screw, the user can unscrew the screw from the key post 140 to a predetermined amount to increase the distance between the top plate 110 and the bottom plate 120. The increased distance/height may be defined as T2. In some examples, the increased height T2 may be in a range of about 4 mm to 14 mm. In other examples, the increased height T2 may have any other suitable value. In some examples, the increased height T2 may be equal to or lower than the height of the post portion 152 of the fastener 150. In some examples, the keycase 100 can be adjusted to have any extended height value equal to or lower than the given maximum extended height T2. For example, when the given maximum extended height T2 is 10 mm, the keycase 100 can be adjusted to have any extended height value between 0 to 10 mm (e.g., 0.5 mm, 1 mm, 3 mm, 4.2 mm, 6.7 mm, . . . ). In some examples, the keycase 100 may be able to hold up to five to ten keys in the extended state. In other examples, the keycase 100 may be able to hold any other number of keys in the extended state.

In some examples, a separate component, such as a driver (e.g., mini-screw driver) or a flat piece, is provided to engage/disengage the fastener 150 to/from the key post 140 and/or the top plate 110. In other examples, the user may be able to engage/disengage the fastener 150 to/from the key post 140 and/or the top plate 110 without a separate component, for example, by using fingers.

In some examples, the keycase 100 may further include a key pushing liner 160. The key pushing liner 160 may be coupled to the longitudinal bottom plate 120. The key pushing liner 160 may be configured to push the one or more keys towards the longitudinal top plate 110. In some examples, the key pushing liner 160 may be made with spring steel, such as low-alloy manganese and medium/high-carbon steel with a high yield strength. In other examples, the key pushing liner 160 may be made with any other suitable material having a high yield strength and/or high elasticity so that it can return to its original shape after some/significant deflection or twisting. The key pushing liner 160 may provide a lateral force (e.g., in the height direction 30) to the one or more inserted keys so that the one or more keys inserted into the key post 140 do not spin around the key post 140, which may reduce or remove the jangling sounds that can be made by the inserted keys.

Figure 6:
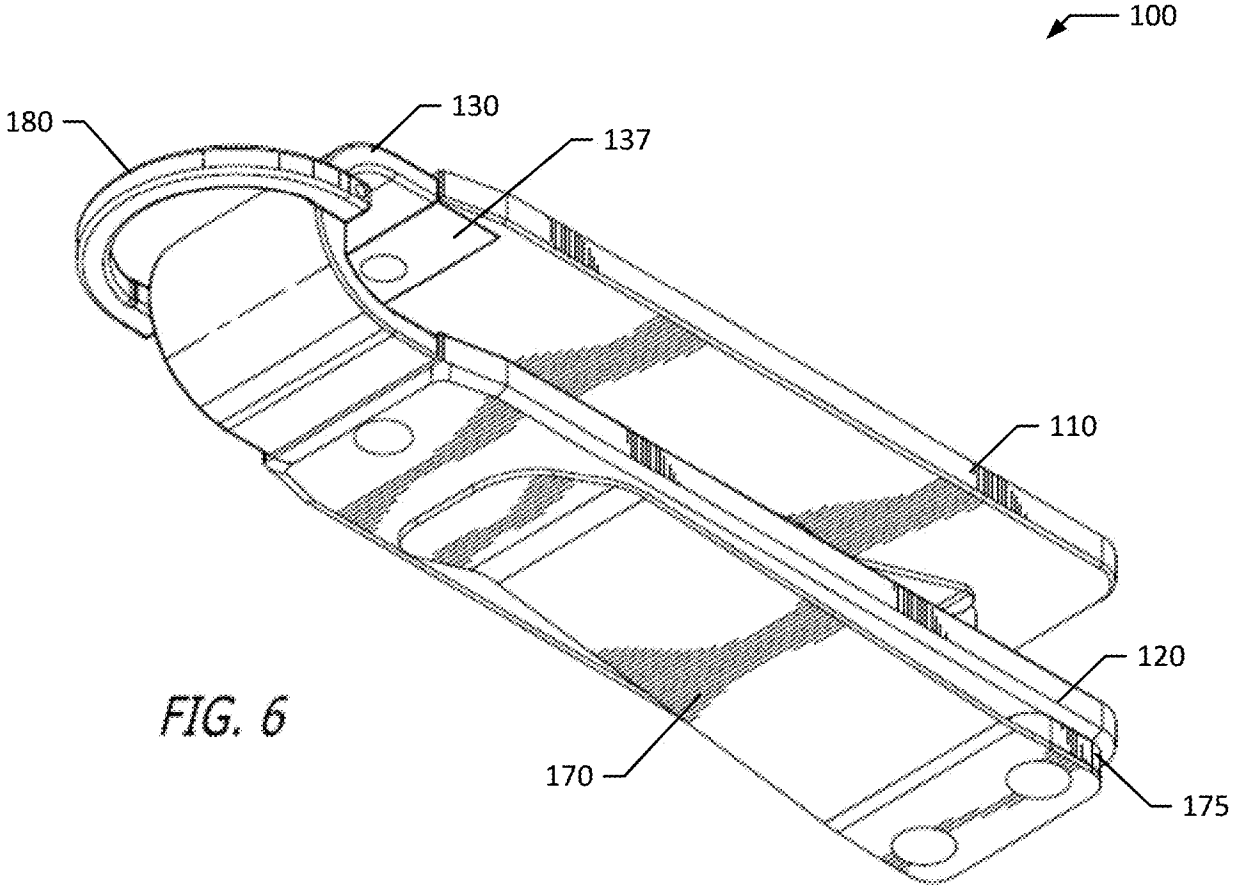
FIG. 6 is a bottom perspective view of the keycase of FIG. 1.

In some examples, the keycase 100 may further include a pocket clip 180. The pocket clip 180 may be coupled to an outer surface of the longitudinal bottom plate 120. Using the pocket clip 180, a user of the keycase 100 can clip the keycase 100 to a pocket in the clothing (e.g., pants, shirts) of the user or to any other suitable place. In some examples, the keycase 100 may also include a spacer 185. The spacer 185 may be coupled between an end portion of the pocket clip 180 and the outer surface of the longitudinal bottom plate 120. The pocket clip 180 may have a longitudinal shape extending in the length direction 10. The pocket clip 180 may have a first end portion connected to the spacer 185 and a second end portion opposite the first end portion. Most portions of the pocket clip 180 may be spaced apart from the outer surface of the bottom plate 120, except for a middle portion (e.g., middle portion near the second end portion as shown in FIG. 6) in which the pocket clip 180 detachably contacts the outer surface of the bottom plate 120.

In some examples, the pocket clip 180 may be made with spring steel, such as low-alloy manganese and medium/high-carbon steel with a high yield strength. In other examples, the pocket clip 180 may be made with any other suitable material having a high yield strength and/or high elasticity so that it can return to its original shape after some/significant deflection or twisting. In some examples, the spacer 185 may be made with a metal material (e.g., aluminum, titanium). In other examples, the spacer 185 may be made with any other suitable material (e.g., plastic, wood).

Figure 5:
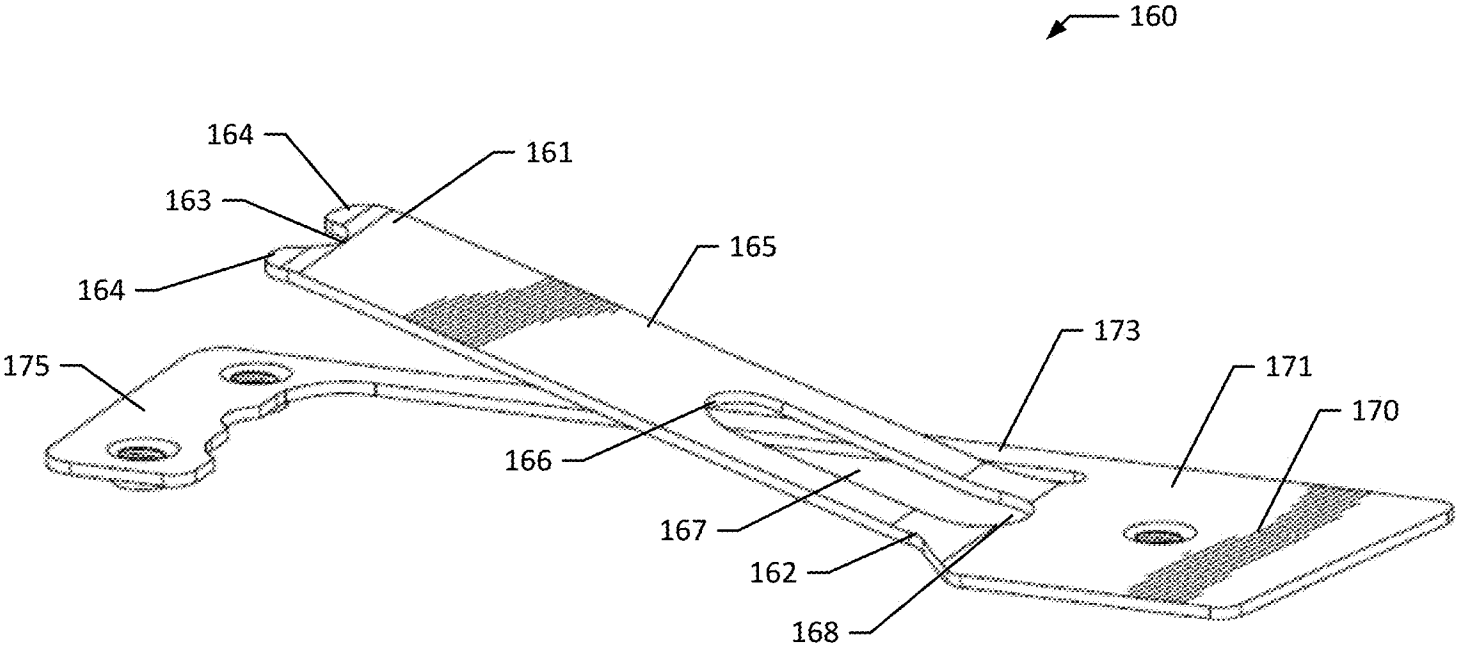
FIG. 5 is a perspective view of a key pushing liner of the keycase of FIG. 1.

Referring to FIGS. 4 and 5, in some examples, the key pushing liner 160 may include a fixed portion 170 and a floating portion 165. The fixed portion 170 may be coupled to an inner surface of the longitudinal bottom plate 120. The floating portion 165 of the key pushing liner 160 may have a first end portion 161 and a second end portion 162 opposite the first end portion 161. The second end portion 162 of the floating portion 165 may be connected to the fixed portion 170 of the key pushing liner 160. The floating portion 165 may extend from the second end portion 162 towards the key post 140 so that the first end portion 161 of the floating portion 165 is located closer to the key post 140 than the second end portion 162 of the floating portion 165.

The first end portion 161 of the floating portion 165 may be spaced apart from the longitudinal bottom plate 120 when no pressure is applied to the floating portion 165 of the key pushing liner 160. When the first end portion 161 of the floating portion 165 is pressed down, it may touch the bottom plate 120, but when the pressing force is removed, the first end portion 161 may return back to its original position. In some examples, the entire floating portion 165, except for the second end portion 162 connected to the fixed portion 170, may be spaced apart from the longitudinal bottom plate 120 when no pressure is applied to the floating portion 165. In some examples, an angle formed between the floating portion 165 and the bottom plate 120 may be in a range of about 0° to about 45°, and more preferably about 10° to about 30°. In other examples, the angle formed between the floating portion 165 and the bottom plate 120 may have any other suitable value.

In some examples, the first end portion 161 of the floating portion 165 may be spaced apart from the key post 140 when no pressure is applied to the floating portion 165 of the key pushing liner 160. In some examples, the distance between the first end portion 161 of the floating portion 165 and the key post 140 may be in a range of 0 mm to 3 mm, and more preferably 0.5 mm to 2.5 mm (when no pressure is applied to the floating portion 165 of the key pushing liner 160). In other examples, the distance between the first end portion 161 of the floating portion 165 and the key post 140 may have any other suitable value. In some examples, when the first end portion 161 is pressed all the way down to touch the bottom plate 120, the distance between the first end portion 161 and the key post 140 may decrease (compared to the distance between the first end portion 161 and the key post 140 when no pressure is applied). In this case, the first end portion 161 may almost touch the key post 140. In other examples, when the first end portion 161 is pressed all the way down to touch the bottom plate 120, the first end portion 161 may touch the key post 140.

In some examples, the first end portion 161 of the floating portion 165 may include a notch 163. In some examples, the notch 163 may be placed in a middle portion (in the length direction 20) of the first end portion 161. In some examples, the notch 163 may be curved. The notch 163 may have a semi-circle shape. In other examples, the notch 163 may have any other suitable shape (e.g., rectangular, triangle). In some examples, the notch 163 may surround the key post 140.

In some examples, the first end portion 161 of the floating portion 165 may include one or more bent portions 164. The one or more bent portions 164 may be substantially in parallel with the top/bottom plate 110/120. The notch 163 and/or the one or more bent portions 164 may allow the key pushing liner 160 to have increased surface areas that can contact the inserted key. This may help the key pushing liner 160 apply sufficient lateral pressure (e.g., in the height direction 30) to the one or more inserted keys regardless of the types of keys (e.g., having a big opening or a hole in a strange shape), thereby allowing the key pushing liner 160 to securely hold the one or more inserted keys horizontally (e.g., substantially in parallel with the top/bottom plate 110/120).

In some examples, the floating portion 165 may include a recess 167 (e.g., an internal recess). The recess 167 may have a first end portion 166 and a second end portion 168. In some examples, the recess 167 may be formed near the second end portion 162 of the floating portion 165. In some examples, the recess 167 may extend towards a middle portion of the floating portion 165. In some examples, the recess 167 may have an oblong shape as shown in FIG. 5. In other examples, the recess 167 may have any other suitable shape (e.g., circle, rectangular). In some examples, a portion of the recess 167 (e.g., second end portion 168) may extend to the fixed portion 170 of the key pushing liner 160.

The size of the recess 167 may affect the stiffness/elasticity of the floating portion 165 of the key pushing liner 160. For example, it may be easier to press the floating portion 165 down (e.g., less force is required) as the size of the recess increases. In some examples, the recess 167 may have a length in a range of about 0 mm to about 20 mm and a width in a range of about 0 mm to about 7 mm. In other examples, the recess 167 may have any other suitable length and width.

In some examples, the fixed portion 170 may include a top portion 175, a middle portion 173, and a bottom portion 171. The top portion 175 may extend in the width direction 20 and the middle portion 173 may extend in the length direction 10. The fixed portion 170 may be fixed to the bottom plate 120 though a fastener, such as a screw, bolt, or any other suitable means (e.g., adhesion layer between the fixed portion 170 and bottom plate 120). In some examples, the key pushing liner 160 may be made from a single (metal) piece (e.g., by stamping a single metal piece), which may increase the durability of the key pushing liner 160 and save the manufacturing time and cost. In other examples, the key pushing liner 160 may be made with multiple pieces. In some examples, the top portion 175 and the middle portion 173 may be optional, and the fixed portion 170 may only include the bottom portion 171.

In some examples, the longitudinal top plate 110 may include a concave portion 115 in a side portion of the longitudinal top plate 110. The concave portion 115 may be configured to assist in pushing the one or more keys out. In some examples, the concave portion 115 may be curved. The concave portion 115 may be in a semi-circle shape. In other examples, the concave portion may have any other suitable shape.

In some examples, the keycase 100 may further include an outer keychain 190. In some examples, the outer keychain 190 may be in a D-ring/semi-circle shape as shown in FIG. 1. In other examples, the outer keychain 190 may have any other suitable shape (e.g., triangle, rectangular). The outer keychain 190 may be able to hold other types of keys/key rings, such as a car key fob.

Reference throughout the specification to "various aspects," "some aspects," "some embodiments," "other embodiments," or "one aspect" means that a particular feature, structure, or characteristic described in connection with the aspect is included in at least one example. Thus, appearances of the phrases "in various aspects," "in some aspects," "certain embodiments," "some embodiments," "other embodiments," "certain other embodiments," or "in one aspect" in places throughout the specification are not necessarily all referring to the same aspect. Furthermore, the particular features, structures, or characteristics illustrated or described in connection with one example may be combined, in whole or in part, with features, structures, or characteristics of one or more other aspects without limitation.

It is to be understood that at least some of the figures and descriptions herein have been simplified to illustrate elements that are relevant for a clear understanding of the disclosure, while eliminating, for purposes of clarity, other elements. Those of ordinary skill in the art will recognize, however, that these and other elements may be desirable. However, because such elements are well known in the art, and because they do not facilitate a better understanding of the disclosure, a discussion of such elements is not provided herein.

The terminology used herein is intended to describe particular embodiments only and is not intended to be limiting of the present disclosure. As used herein, the singular forms "a," "an," and "the" are intended to include the plural forms as well, unless otherwise indicated. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term 'at least one of X or Y' should be interpreted as X or Y, or X and Y.

It should be understood that various changes and modifications to the examples described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A keycase comprising:

a longitudinal top plate;

a longitudinal bottom plate;

a flexible connector connecting the longitudinal top plate and the longitudinal bottom plate;

a key post coupled to the longitudinal bottom plate and extending from the longitudinal bottom plate toward the longitudinal top plate, wherein the key post is configured to hold one or more keys;

a fastener configured to detachably connect the key post and the longitudinal top plate and secure the key post with the longitudinal top plate; and a key pushing liner coupled to the longitudinal bottom plate and configured to push the one or more keys toward the longitudinal top plate.

2. The keycase of claim 1, wherein the flexible connector is made of a silicon material.

3. The keycase of claim 1, further comprising a pocket clip coupled to an outer surface of the longitudinal bottom plate.

4. The keycase of claim 3, further comprising a spacer coupled between an end portion of the pocket clip and the outer surface of the longitudinal bottom plate.

5. The keycase of claim 1, wherein the key pushing liner comprises a fixed portion and a floating portion, wherein the fixed portion is coupled to an inner surface of the longitudinal bottom plate.

6. The keycase of claim 5, wherein the floating portion of the key pushing liner comprises a first end portion and a second end portion opposite the first end portion, wherein the second end is connected to the fixed portion of the key pushing liner, wherein the floating portion extends from the second end portion towards the key post so that the first end portion of the floating portion is located closer to the key post than the second end portion of the floating portion, and wherein the first end of the floating portion is spaced apart from the longitudinal bottom plate when no pressure is applied to the floating portion of the key pushing liner.

7. The keycase of claim 6, wherein the first end portion of the floating portion is spaced apart from the key post when no pressure is applied to the floating portion of the key pushing liner.

8. The keycase of claim 7, wherein a distance between the first end portion of the floating portion and the key post is in a range of 0.5 mm to 3 mm.

9. The keycase of claim 7, wherein the first end portion of the floating portion comprises a notch.

10. The keycase of claim 7, wherein the first end portion of the floating portion comprises a bent portion.

11. The keycase of claim 5, wherein the floating portion comprises an internal recess.

12. The keycase of claim 1, wherein the key pushing liner is made from a single metal piece.

13. The keycase of claim 1, wherein the longitudinal top plate comprises a concave portion in a side portion of the longitudinal top plate, wherein the concave portion is configured to assist in pushing the one or more keys out.

14. The keycase of claim 1, wherein the fastener comprises a screw.

15. A keycase comprising:

a longitudinal top plate having a first end portion and a second end portion opposite the first end portion;

a longitudinal bottom plate having a first end portion and a second end portion opposite the first end portion;

a connector connecting the longitudinal top plate and the longitudinal bottom plate, wherein the connector comprises a first end portion and a second end portion opposite the first end portion, wherein the first end portion of the connector is connected to the second end portion of the longitudinal top plate and the second end portion of the connector is connected to the second end portion of the longitudinal bottom plate;

a key post coupled to the first end portion of the longitudinal bottom plate and extending from the first end portion of the longitudinal bottom plate toward the first end portion of the longitudinal top plate, wherein the key post is configured to hold one or more keys;

a fastener configured to detachably connect the key post and the first end portion of the longitudinal top plate and secure the key post with the longitudinal top plate; and a key pushing liner coupled to the longitudinal bottom plate and configured to push the one or more keys toward the longitudinal top plate.

16. The keycase of claim 15, wherein the connector is made of a flexible material.

17. The keycase of claim 15, wherein the key pushing liner comprises a fixed portion and a floating portion, wherein the fixed portion is coupled to an inner surface of the longitudinal bottom plate.

18. The keycase of claim 17, wherein the floating portion of the key pushing liner comprises a first end and a second end opposite the first end, wherein the second end is connected to the fixed portion of the key pushing liner, wherein the floating portion extends from the second end toward the key post so that the first end of the floating portion is located closer to the key post than the second end of the floating portion, and wherein the first end of the floating portion is spaced apart from the longitudinal bottom plate when no pressure is applied to the floating portion of the key pushing liner.

19. The keycase of claim 6, wherein the first end of the floating portion is spaced apart from the key post when no pressure is applied to the floating portion of the key pushing liner.

20. A key pushing liner for a keycase, comprising:

a fixed portion configured to be fixed to a bottom plate of the keycase; and a floating portion connected to the fixed portion, wherein the floating portion includes a first end portion and a second end portion opposite the first end portion, wherein the second end portion of the floating portion is connected to the fixed portion, wherein the floating portion is bent from the fixed portion and the first end portion of the floating portion is floating.

* * * * *